US006780033B2

(12) United States Patent
Liu

(10) Patent No.: US 6,780,033 B2
(45) Date of Patent: Aug. 24, 2004

(54) EASILY OPERABLE UNIVERSAL SAFETY ADAPTOR

(75) Inventor: Ke-Chih Liu, Taipei (TW)

(73) Assignee: Ahoku Electronic Company, Taipei (TW)

( * ) Notice: Subject to any disclaimer, the term of this patent is extended or adjusted under 35 U.S.C. 154(b) by 26 days.

(21) Appl. No.: 10/226,131

(22) Filed: Aug. 23, 2002

(65) Prior Publication Data

US 2004/0038572 A1 Feb. 26, 2004

(51) Int. Cl.[7] ..... H01R 29/00
(52) U.S. Cl. ..... 439/172
(58) Field of Search ..... 439/172, 171, 439/145, 137

(56) References Cited

U.S. PATENT DOCUMENTS 4,973,827 A * 11/1990 Nozaki ..... 439/172
4,997,381 A * 3/1991 Oh ..... 439/172
5,613,863 A * 3/1997 Klaus et al. ..... 439/172
5,791,921 A * 8/1998 Lee ..... 439/172
6,109,977 A * 8/2000 Baxter et al. ..... 439/171
6,520,787 B1 * 2/2003 Lott ..... 439/171

* cited by examiner

*Primary Examiner*—Javaid H. Nasri

(57) ABSTRACT

A safety easily operable universal adaptor which mainly disposed with a safety device and a set of shutter whereupon a control rod of the safety device is displaced toward the right and left in opposition to an up and down motion of a positioning block and then forcibly limited each plug pin to keep in position so as to enable only single set of the plug pin can be protruded outwardly; the set of shutter is disposed in the inner side of an socket of an adaptor body and then push the shutter away when a plug is inserted therein, so as to insert the socket and electrically connect to a electrically conductive plate therebetween; by virtue of this arrangement, an electrified state is formed between the plug and the plug pin.

9 Claims, 13 Drawing Sheets

EASILY OPERABLE UNIVERSAL SAFETY ADAPTOR

FIELD OF THE INVENTION

This invention relates to an easily operable universal safety adaptor, and more particularly to a current adaptor in which only a single set of the plug pin can be protruded outwardly and conduct electricity and which a suitable shutter is provided to the socket.

BACKGROUND OF THE INVENTION

A conventional safety adaptor is provided for an adaptor body disposed with varied types of sockets in conformity with different countries, such as American, United Kingdom, Australian and European, and one set of varied plug pins corresponding to an outer adaptor is selected for insertion, thereby allowing the adaptor to conduct electricity. However, when a user uses a conventional easily operable universal safety adaptor, all they can do is correctly insert a single set of exposed plug pins, without any safety device for keeping the rest of the plug pins from being exposed. Thus, when users select a specific set of exposed plug pins to insert in a corresponding outer adaptor, the rest of the plug pins would be exposed and outwardly protrude, and resulting in a risk of an electric shock or short circuit.

It is therefore tried by the inventor to develop an easily operable universal safety adaptor, especially an easily operable universal safety adaptor having a safety device and a security shutter for eliminating the above-mentioned problems and drawbacks.

SUMMARY OF THE INVENTION

Accordingly, it is a primary object of the present invention claimed herein to provide a safety easily operable universal adaptor, which is enable to achieve forcefully protection by the function of a safety device and a security shutter, so as to improve the security in use.

It is another object of the present invention to provide a safety easily operable universal adaptor, which is enable to make an inner side of an adaptor correspond with the position of each set of a plug pin in action and further dispose with a safety device displaced toward the right and left in opposition to an up and down motion of a positioning block and then forcibly limited each set of the plug pin to keep in position so as to enable only single set of the plug pin can be protruded outwardly without limitation thereby preventing the rest plug pins from exposing and getting the risk of an electric shock or short circuit.

A further object of the present invention is to provide a safety easily operable universal adaptor, wherein a set of shutter is disposed in the inner side of an socket of the adaptor and then push the shutter away so as to insert a plug into the socket and electrically connect to the electrically conductive plate; by virtue of this arrangement, an electrified state is formed in the plug and the plug pin.

BRIEF DESCRIPTION OF THE DRAWINGS

The structure adopted by the present invention to achieve the above and other objects can be best understood by referring to the following detailed description of the preferred embodiments and the accompanying drawings, wherein.

DETAIL DESCRIPTION OF THE REFERRED EMBODIMENTS

Figure 1:
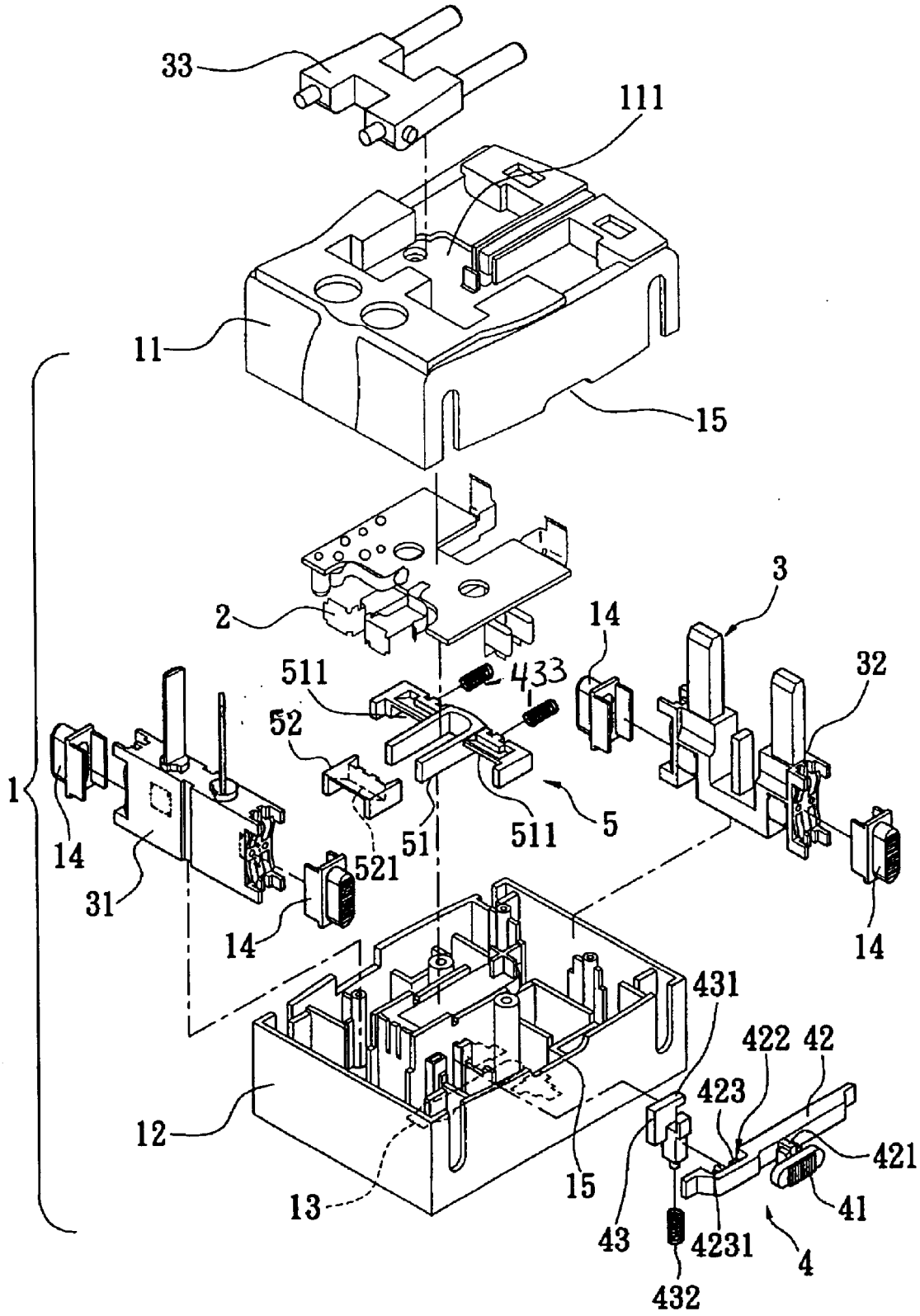
FIG. 1 is an exploded view illustrating a safety easily operable universal adaptor according to the present invention.

With references to the drawings, an easily operable universal safety adaptor according to the present invention comprises an adaptor body 1, an electrically conductive plate 2, a set of plug pins 3, a safety device 4 and a set of shutter 5.

The adaptor body 1 includes an upper cover 11 and a lower cover 12 in opposition to each other, as shown in FIG. 1. A socket 13 for the insertion of a plug is provided on the surface of the lower cover 12 wherein the socket 13 corresponds to various plugs, such as the American type plug, the United Kingdom type plug, the Australian type plug and the Europe type plug, and without limitation. Also, two blocks 14 are disposed in both sides of the adaptor body 1 for controlling the lengthened and shortened motion of the plug pins. A groove 111 is provided in the surface side of the upper cover 11.

The electrically conductive plate 2 is disposed in the inner side of the upper cover 11 and corresponds to the socket 13.

Figure 2:
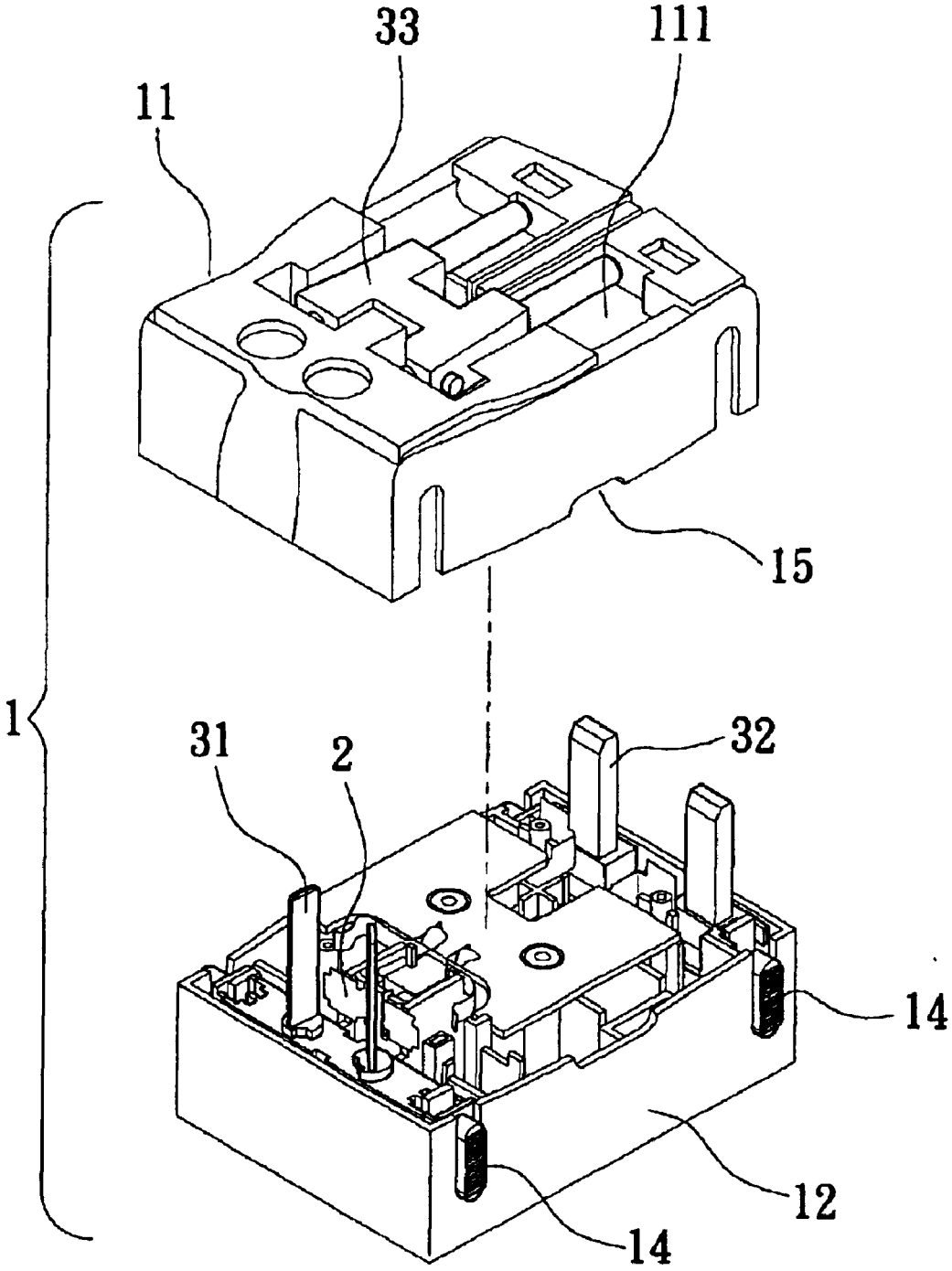
FIG. 2 is a part of an assembly exploded view illustrating safety easily operable universal adaptor according to the present invention.

The plug pin 3 includes a first plug pin 31 for the American type plug and the Australian type plug collectively, a second plug pin 32 for the United Kingdom type plug and a third plug pin 33 for the European type plug. The first plug pin 31 and the second plug pin 32 are respectively vertically accommodated in the front end and the rear end of the adaptor body 1. The third plug pin 33 is horizontally disposed in the groove 111 of the upper cover 11, as shown in FIG. 2. The first plug pin 31 and the second plug pin 32 protrude from the surface of the upper cover 11 by the motion of the block 14 and the bottom ends thereof are capable of contacting the electrically conductive plate 2. The third plug 33 is in contact with the electrically conductive plate 2 in the inside of the adaptor body 1, after it is turned upward from the surface of the upper cover 11.

Figure 6:
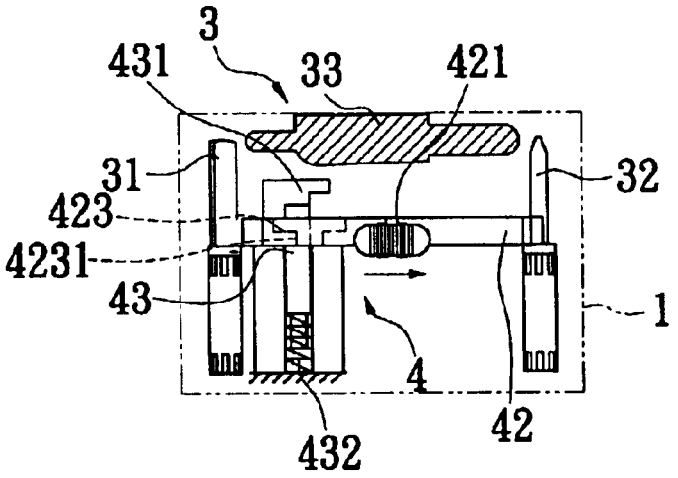
Figure 7:
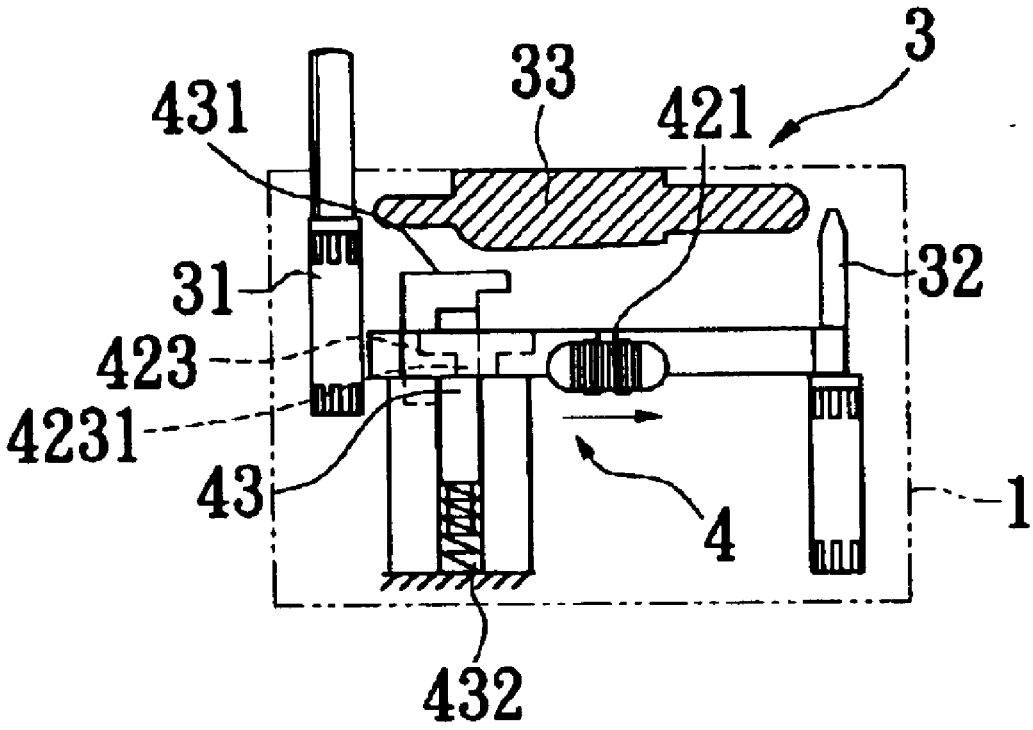

This invention is characterized in that the safety device 4 is formed with a push button 41, a control rod 42 and a positioning block 43. The push button 41 is accommodated in a sliding groove 15 formed on a lateral surface of the upper cover 11 and the lower cover 12. The control rod 42 is formed in a long rod shape wherein a protrusion 421 is disposed in the outer side of the rod and is covered by the push button 41. A guiding groove 422 is disposed on an inner surface of the rod, and opposing steps 423 are disposed on the inner side of the rod. A smaller groove 4231 is disposed between the steps, as best seen in FIGS. 6 and 7. The positioning block 43 is formed as a pillar wherein a curve salient and an approximately L shaped block 431 are formed at a top end thereof, respectively, and a convex rod provided for a return spring 432 to insert thereon is disposed at a bottom end thereof. The return spring 432 is insertable from the top of the guiding groove 422 through the bottom end of the positioning block 43, and the guiding groove 422 is engagable with the protruded side of the positioning block 43 with the movement of the push button 41 so as to control the motion of both sides of the control rod 42. Therefore, the up and down motion of the positioning block 43 is limited by the protruded side of the positioning block 43 via the fastening of the step 423.

The shutter 5 set is supported by an elastic component 433. Flexibly disposed in the inner side of the socket 13 is a main shutter 51 and a secondary shutter 52. Both sides of the main shutter 51 correspond to the plate surface of the socket 13. Two inclined planes 511 are disposed on the main shutter 51, and an inclined plane 521 is disposed on the center of the secondary shutter 52, corresponding to the plate surface of the socket 13 respectively.

By utilizing the above-mentioned members, the control rod 42 of the safety device 4 is thus transversely disposed in the inner side wall of the adaptor body 1, and is turned in correspondence with the up and down motion of the positioning block 43 by the push button 41, so that the control rod 42 and the positioning block 43 are capable of limiting or releasing the interruption to each plug pin 3 depending on the locations thereof. By virtue of this arrangement, the adaptor may be provided with protection. Meanwhile, the shutter set 5 is sealed in the inner side of the socket 13, and the plug 6 may only be inserted in correct way in which the position of the main shutter 51 or the secondary shutter 52 is transposed by utilizing any inclined planes 511, 521, so as to form an electrified state between the plug 6 and the protrusive plug pin 3 and prevent an improper foreign matter from being inserted into the socket 13.

Figure 3:
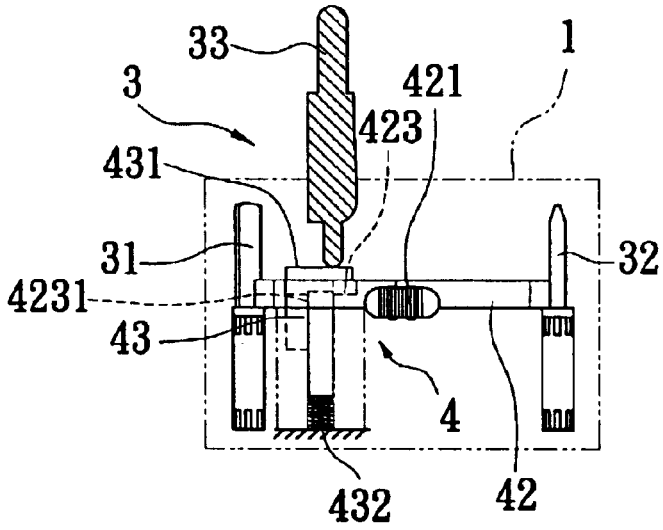
FIG. 3 to FIG. 7 is a part of an assembly exploded view illustrating the moving of the safety device according to the present invention.

Further, the mechanism of this invention for effectively restraining the plug pin from an improper protrusion will be described as follows: First, when the control rod 42 and the position block are moved by the push button 41 and then kept in the center of the sliding groove 15 as shown in FIG. 3, because both side of the control rod 42 may only be fastened in the upper side end of the first plug pin 31 and the second plug pin 32 and the L shaped block 431 of the position block 43 located within the groove 4231 is located in the lower end of the third plug 33, the position block 43 held against by the return spring 432 is then downwardly moved into the groove 4231, so as to prevent the upwardly reversed motion of the third plug pin 33 from being interrupted by the L shaped block 431. Thus, the adaptor may be electrically connected by outwardly reversing the third plug pin 33 only.

Figure 4:
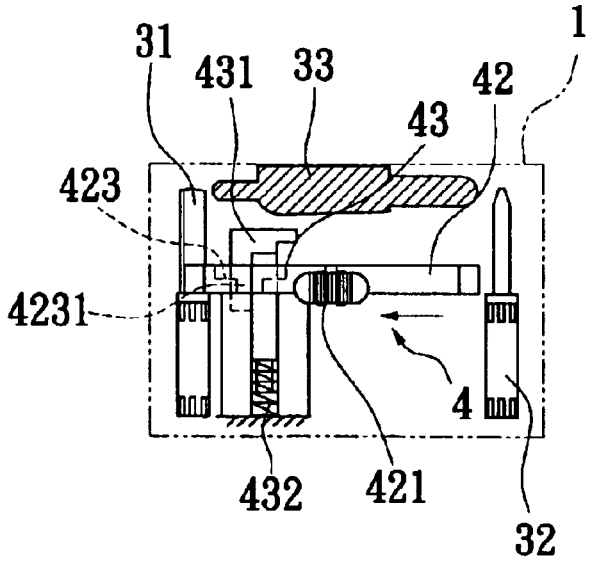
Figure 5:
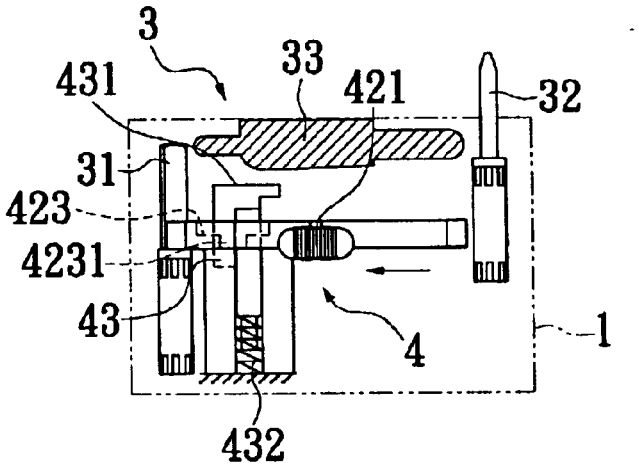

Further, when the control rod 42 and the position block 43 are moved by the push button 41 and then kept in the left side of the sliding groove 15 as shown in FIG. 3, because the left side of the control rod 42 may only be fastened in the upper side of the first plug pin 31 and limited the first plug pin 31 to protrude outwardly, the control rod 42 is displaced toward the left and the protruded side of the position block 43 located on the top of the step 423 is supported thereof. Therefore, when the third plug pin 33 is on the point of upwardly reversing, because the end of the third plug pin 33 is downwardly reversed against the limited position block 43 and the protruded side of the position block 43 held upwardly by the step 423 is unable to go down, so as to prevent the third plug pin 33 from being outwardly reversed thereof, as shown in FIG. 4. Therefore, the second plug pin 32 without being pressed by the control rod 42 is protruded outwardly by the motion of the block 14 and thus the adaptor may be electrically connected therein, as shown in FIG. 5.

Moreover, when the control rod 42 and the position block 43 are moved by the push button 41 and then kept in the right side of the sliding groove 15 as shown in FIG. 3, making the right side of the control rod 42 be fastened in the upper side of the second plug pin 32 so as to limit the second plug pin 32 from being protruded outwardly. Therefore, when the third plug pin 33 moved toward the right by the control rod 42 is on the point of upwardly reversing, because the end of the third plug pin 33 is limited to outwardly reverse by the intercept of the L shaped block 431, as shown in FIG. 7. Thus, the first plug pin 31 is protruded outwardly by the motion of the block 14 and the adaptor may be electrically connected therein, as shown in FIG. 7.

By virtue of the above-mentioned arrangement, the control rod 42 of the safety device 4 is displaced toward the right and left in opposition to an up and down motion of a positioning block 43 and forcibly limited each plug pin to keep in position so as to enable only single set of the plug pin can be protruded outwardly without the interruption of the plug pin 3 thereby forcefully protection has been achieved and the security in use has been improved.

Figure 8:
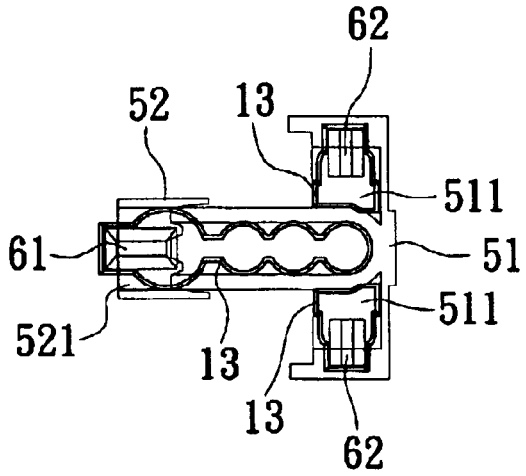
FIG. 8 and FIG. 9 show the state when the set of shutter is pushed and displaced by the plug according to the present invention.
Figure 9:
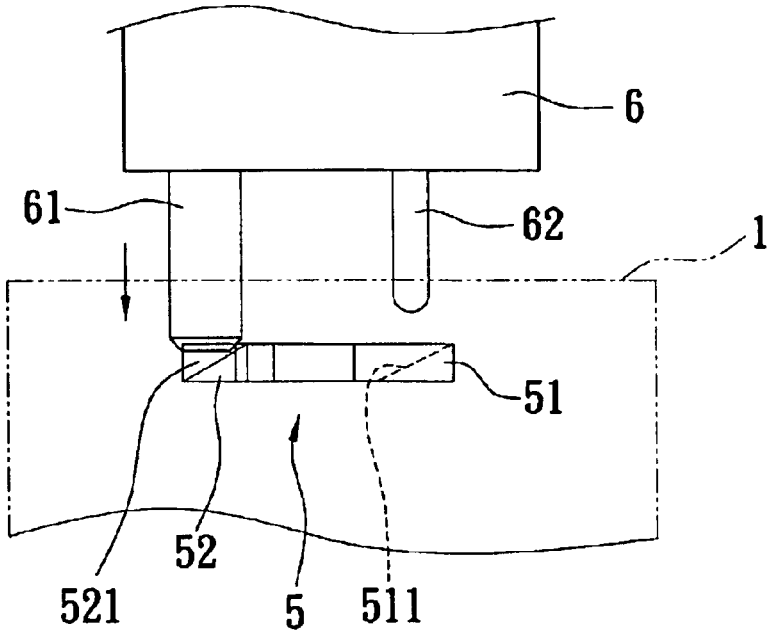
Figure 10:
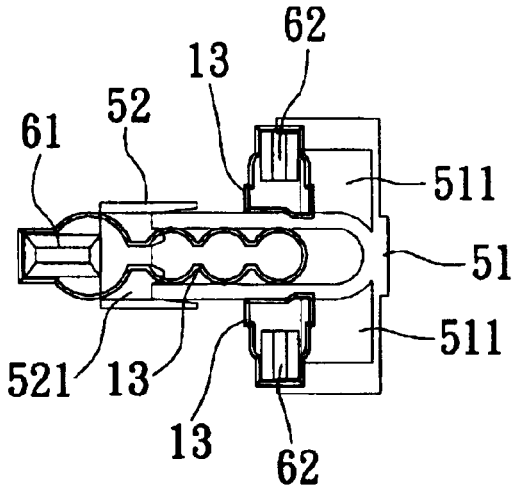
FIG. 10 and FIG. 11 show the state when the set of shutter is completely displaced and the plug is smoothly inserted therein according to the present invention.
Figure 11:
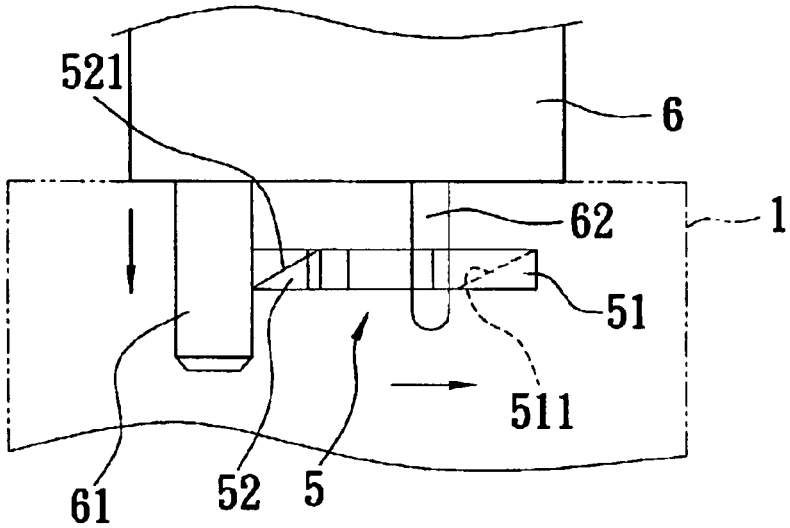
Figure 12:
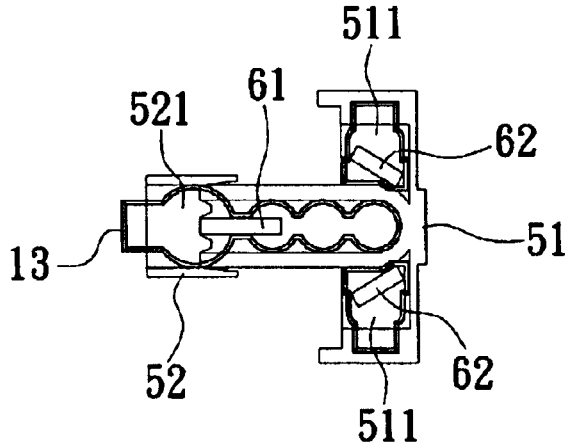
FIG. 12 to FIG. 15 shows the insertion state of the Australian type plug.
Figure 13:
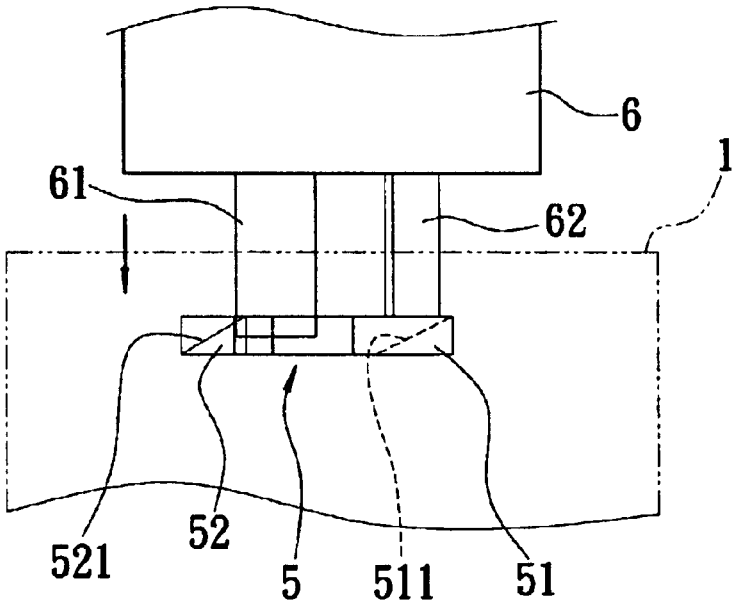
Figure 14:
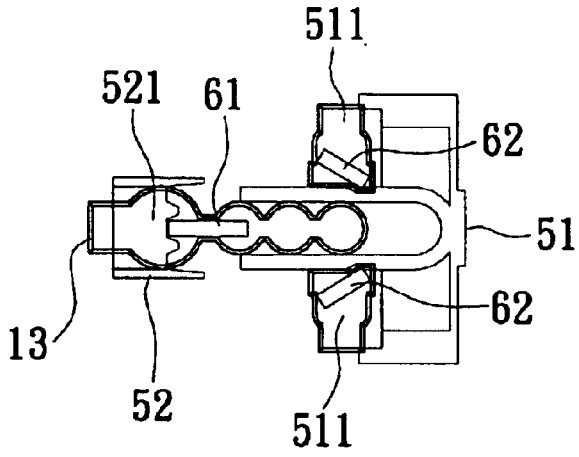
Figure 15:
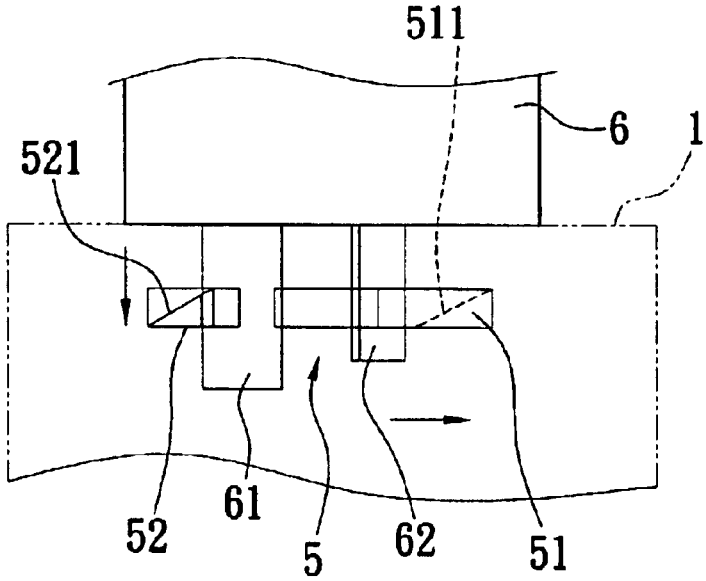
Figure 16:
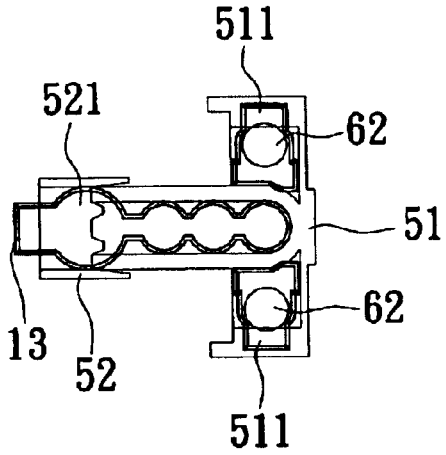
FIG. 16 to FIG. 19 shows the insertion state of the Europe type plug; and FIG. 20 to FIG. 23 shows the insertion state of the American type plug.
Figure 17:
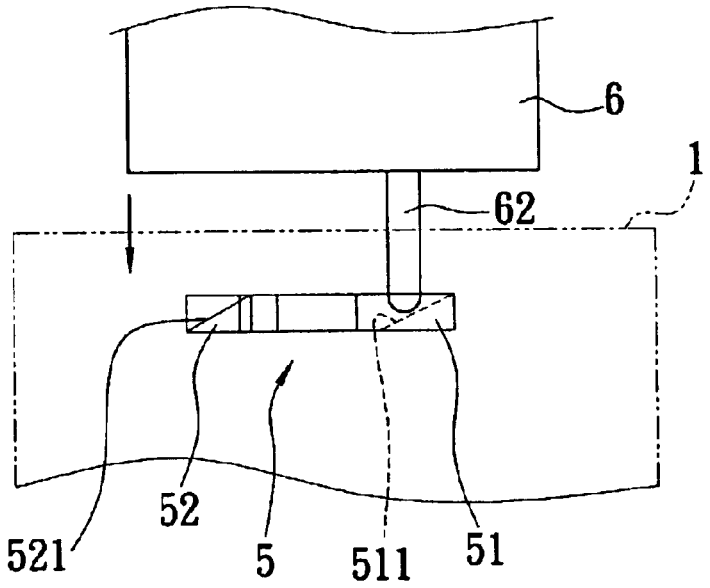
Figure 18:
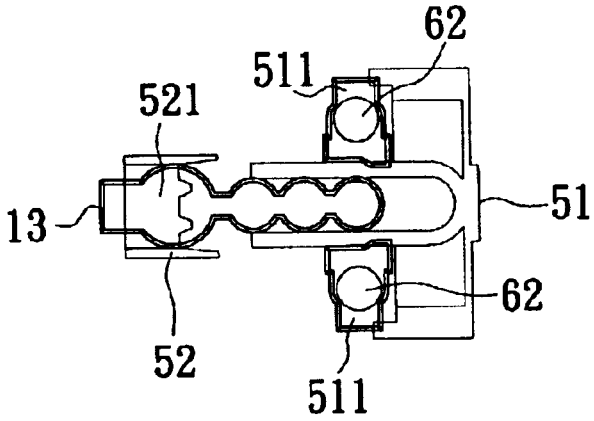
Figure 19:
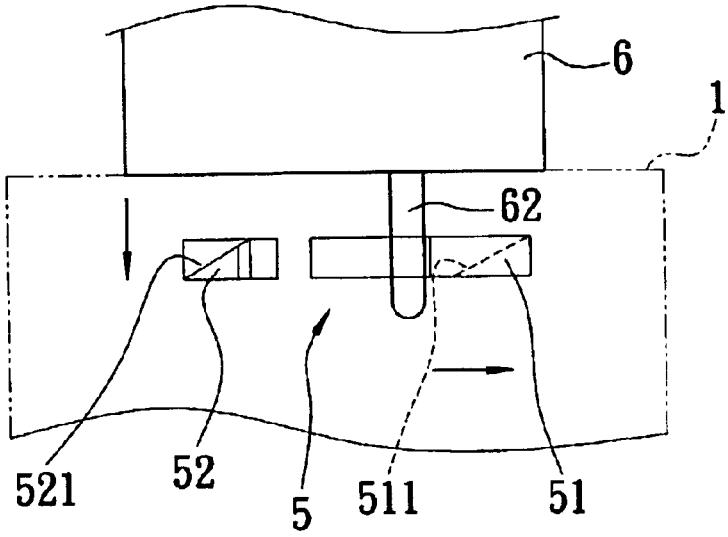
Figure 20:
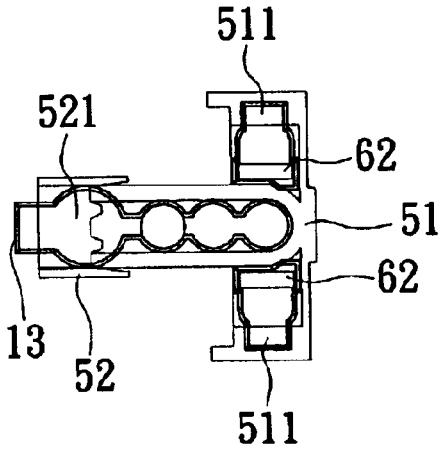
Figure 21:
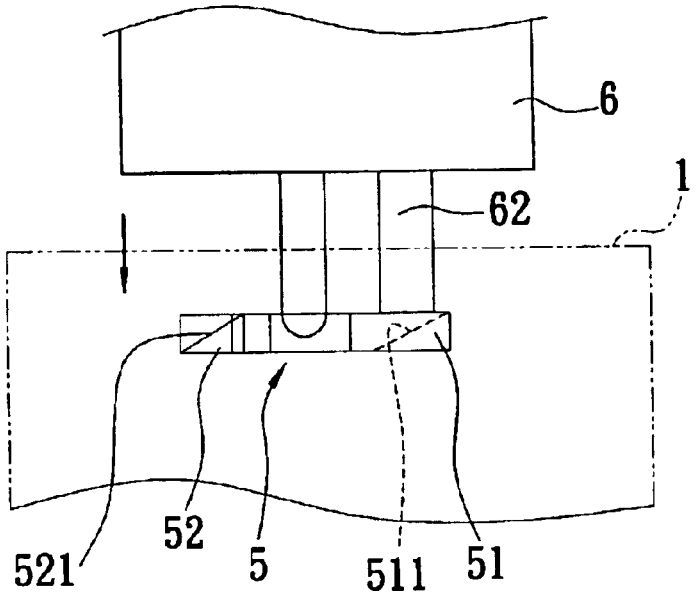
Figure 22:
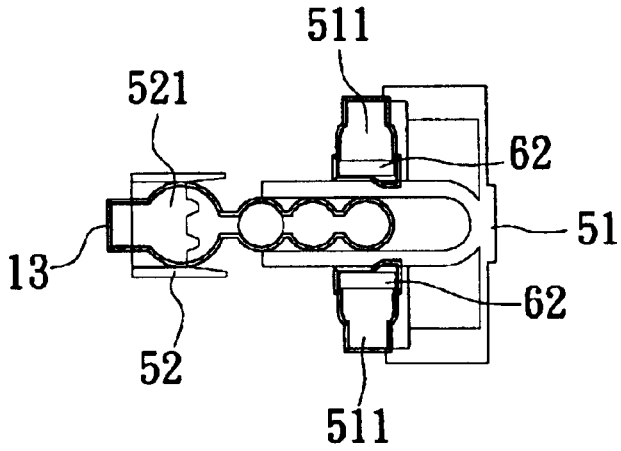
Figure 23:
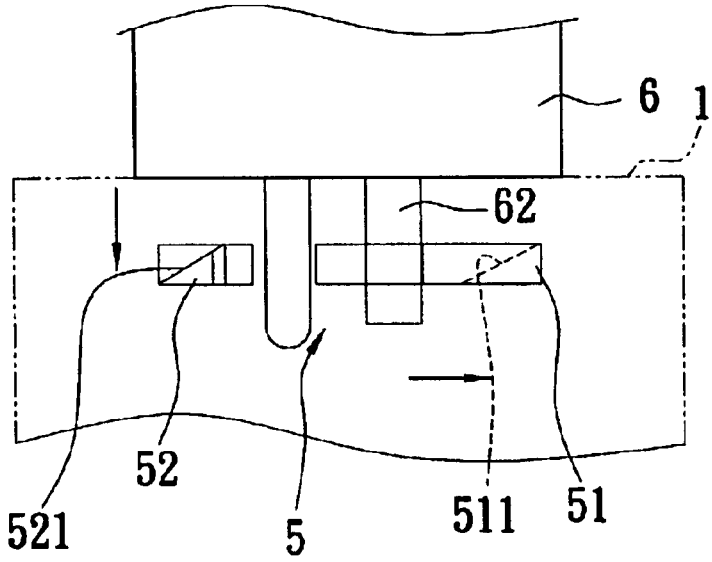

Furthermore, as shown in FIG. 8 and FIG. 9, because a grounding pin 61 longer than a conductive pin 62 is provided for the United Kingdom type plug, when the United Kingdom type plug according to the present invention is inserted through the socket 13, the inclined plane 521 is first pressed by the grounding pin 61 and then the secondary shutter 52 is displaced onward therein. Also, the main shutter 51 is moved accordingly so as to make the conductive pin 62 of the socket 13 is inserted into the electrically conductive plate 2 smoothly and an electrified state is formed between the plug 6 and the plug pin 3, as shown in FIG. 10 and FIG. 11. Similarly, as the insertion state of varied type plugs are shown in FIG. 12 to FIG. 23, two conductive pins 62 of the plug 6 are inserted into the socket 13 simultaneously and is further pushed against the main shutter 51 by two inclined planes 511, 521 of the main shutter 51, so that the plug 6 may be electrically connected therein.

What is claimed is:

1. An easily operable universal safety adaptor, comprising:

an adaptor body including an upper cover and a lower cover in opposition to each other, and a socket for the insertion of a plug provided on a surface of the lower cover;

at least two blocks disposed at opposing sides of the adaptor body for controlling a lengthened and shortened motion of plug pins;

a plug pin set, including a first plug pin, a second plug pin and a third plug pin, each plug pin being adapted to enter into and be accommodated within the adaptor body, and to protrude from a surface of the upper cover by a motion of the blocks;

an electrically conductive plate disposed at an inner side of the upper cover, and corresponding to the socket; and including a push button, a control rod and a positioning block, the push button being accommodated in a sliding groove formed on a lateral surface of the upper cover and the lower cover, and the control rod being a long rod shape, and having a protrusion disposed at an outer side thereof, the protrusion being covered by the push button, the control rod further having a guiding groove disposed at an inner side thereof, the guiding groove having opposing steps disposed therein, and a smaller groove disposed between the steps, a top end of the positioning block being respectively formed with a salient curve and an approximately L shaped block, and a convex rod provided for a return spring inserted thereon being disposed at a bottom end of the positioning block, so as to allow the return spring to be inserted from a top of the guiding groove using the bottom end of the positioning block, and the guiding groove engaging a protruded side of the positioning block;

the control rod being transversely disposed at an inner side wall of the adaptor body, the control rod being movable in correspondence with an up and down motion of the positioning block by the push button, so that the control rod and the positioning block are capable of limiting or releasing an interruption of each plug pin depending on locations thereof, thereby providing the adaptor with forcible protection.

2. The universal adaptor as claimed in claim 1, wherein the positioning block is formed as a pillar.

3. An easily operable universal safety adaptor, comprising:

an adaptor body including an upper cover and a lower cover in opposition to each other, and a socket for the insertion of a plug provided on a surface of the lower cover;

at least two blocks disposed at opposing sides of the adaptor body for controlling a lengthened and shortened motion of plug pins;

a plug pin set, including a first plug pin, a second plug pin and a third plug pin, each plug pin being adapted to enter into and be accommodated within the adaptor body, and to protrude from a surface of the upper cover by a motion of the blocks;

an electrically conductive plate disposed at an inner side of the upper cover, and corresponding to the socket; and a shutter set supported by an elastic component and being flexibly disposed at an inner side of the socket, and including a main shutter and a secondary shutter, both sides of the main shutter corresponding to a plate surface of the socket, with each side having an inclined plane, the secondary shutter having an inclined planes disposed at a center thereof and in correspondence with the plate surface of the socket;

wherein when a grounding pin or a conductive pin of the plug is inserted into the adaptor, a position of the main shutter or the secondary shutter is transposed by utilizing any of the inclined planes, thus allowing the plug to be inserted into the socket and electrically connected with the electrically conductive plate to electrify therebetween.

4. The universal adaptor as claimed in claim 1, wherein the first plug pin is adapted to switch into a plug pin of an American type plug or an Australian type plug.

5. The universal adaptor as claimed in claim 1, wherein the second plug pin is a United Kingdom type plug.

6. The universal adaptor as claimed in claim 1, wherein the third plug pin is a European type plug.

7. The universal adaptor as claimed in claim 3, wherein the first plug pin is adapted to switch into a plug pin of an American type plug or an Australian type plug.

8. The universal adaptor as claimed in claim 3, wherein the second plug pin is a United Kingdom type plug.

9. The universal adaptor as claimed in claim 3, wherein the third plug pin is a European type plug.

* * * * *